United States Patent [19]

Sheridon

[11] Patent Number: 5,075,186

[45] Date of Patent: Dec. 24, 1991

[54] IMAGE-WISE ADHESION LAYERS FOR PRINTING

[75] Inventor: Nicholas K. Sheridon, Saratoga, Calif.

[73] Assignee: Xerox Corporation, Stamford, Conn.

[21] Appl. No.: 450,698

[22] Filed: Dec. 13, 1989

[51] Int. Cl.[5] ..... G03G 13/14

[52] U.S. Cl. ..... 430/47; 430/126; 355/280

[58] Field of Search ..... 430/47, 110, 126

[56] References Cited

U.S. PATENT DOCUMENTS

| | | | |
|---|---|---|---|
| 3,640,746 | 2/1972 | Haas | 430/48 |
| 4,368,250 | 1/1983 | Cooper et al. | 430/109 |
| 4,464,453 | 8/1984 | Cooper et al. | 430/126 |

OTHER PUBLICATIONS

Xerography and Related Processes, Dessauer and Clark, 1965 Focal Press Limited, p. 273 and 462.

*Primary Examiner*—John Goodrow

[57] ABSTRACT

A xerographic marking apparatus including a charge receptor member, means for creating an electrostatic latent image on the charge receptor member, means for developing the electrostatic latent image for making it visible, and means for transfering and fixing the visible image onto a transfer sheet. The means for developing comprises first means for electrostatically depositing a colorless adhesive developer material upon the electrostatic latent image, and second means for coloring the colorless adhesive developer material.

23 Claims, 6 Drawing Sheets

IMAGE-WISE ADHESION LAYERS FOR PRINTING

FIELD OF THE INVENTION

The present invention relates to the field of xerography wherein an electrostatic latent image is formed upon an image receptor surface and is subsequently made visible with colored marking particles. More particularly, this invention relates to the use of a developer material comprising colorless adhesive particles to which colored marking particles are applied.

BACKGROUND OF THE INVENTION

As used hereinafter, the word "xerography" is used to denote any imaging process wherein there is formed a pattern of electrostatic charges upon an image receptor. In "electrophotography" a uniform electrostatic charge is placed on a photoconductive insulating layer known as a photoreceptor, the photoreceptor is then exposed to a projected image of light and shadow whereby the surface charge on the areas exposed to light is dissipated, leaving an image-wise pattern of charges on the photoreceptor, known as an electrostatic latent image. In "laser xerography", a uniformly charged photoreceptor is discharged by the selective projection of a laser light source thereon, leaving a charge pattern on the photoreceptor. In "ionography" charged particles (air ions) are directly deposited, in an imagewise pattern, upon a conductively backed dielectric surface, known as a charge receptor. In each of these xerographic processes the electrostatic latent image is then developed, i.e. made visible, by the application of a finely divided particulate colorant, known as toner, in either powder or liquid form. The resultant developed image may then be transferred to a substrate, such as paper, and may be permanently affixed thereto by heat, pressure, a combination of heat and pressure, or other suitable fixing means such as solvent or overcoating treatment.

In the development step of the imaging process, the finely divided pigmented particles are brought into the vicinity of the electrostatic latent image by a transport mechanism, and will be attracted the image if they themselves bear an electrostatic charge opposite to that of the image areas on the charged surface. The toner particles used in xerography must become electrically charged in some manner either prior to or during the developing process in order to insure efficient and complete development of the image. When the toner is a dry powder, triboelectric charging (i.e. the appearance of static charges on insulating materials due to contact or friction) is the mechanism used. In the case of liquid toners, the finely divided particles suspended in a dielectric liquid become charged by virtue of their electrokinetic relationship with the surrounding liquid. Both of these particle charging phenomena are surface effects and are critically dependent upon traces of contamination and other factors affecting the nature of the surfaces involved.

Electrostatic images can be developed with dry powders by a number of different techniques. For example, a powder cloud may be generated adjacent the charged surface or the powder simply may be poured over the surface to be developed. In carrying out these mechanical operations, triboelectrification occurs and some of the particles acquire an electrical charge opposite in polarity to that of the image and hence are held on the image. For better control of the development process, the toner powder is mixed with a much coarser, granular, carrier material, and the mixture is cascaded, i.e. caused to flow, over the charged surface. In brush development, a carrier brush of mechanical or magnetic form transports the toner across the image area while simultaneously giving the toner the proper electrical charge. The carrier material selected for use with a given toner powder material must produce a triboelectric charge on the surface of the toner powder particles opposite in polarity to that of the image to be developed. Liquid development is usually effected by immersing the charged surface in an insulating liquid containing toner particles suspended therein.

Although a variety of materials can be used to develop xerographic images, such materials must be formulated to exacting standards to provide the specific physical properties required by the selected developing, transfer and fixing techniques employed and the requirements established for the final printed image. In general, a satisfactory powder developer material must have a number of attributes, some of which are: it should have a uniform chemical composition; it must be pulverizable or otherwise dispersible into fine particles and have a narrow optimum particle size distribution; it must have the proper color, color intensity and color density, and the proper transparency or opacity; it must be capable of accepting and retaining electrical charges of the correct sign; it should have no adverse effects on the environment nor should it adversely affect the charge receptor surface; it should have the proper characteristics for being fixed to a copy sheet, e.g. a melting point within the proper range for heat fixing or sufficient solubility for solvent vapor fixing; it should be easily cleaned from the image receptor without sticking or streaking; it should not agglomerate in storage; it should have an adequate shelf life: and, perhaps most important, it should be reproducible. If carrier particles are used with it to impart the proper triboelectric charge, the carriers must also be designed to satisfy exacting specifications.

An ideal liquid developer would have many of the same attributes as toner powder, such as color, surface charge magnitude and polarity, shelf life and reproducibility. Additionally, it should have good dispersibility, have the ability to maintain stability in solution, and be self fixing upon evaporation of the liquid carrier. The liquid medium should have a high volume resistivity so that the rate of destruction of the electrostatic image is minimized, a high dielectric constant and a high vapor pressure for quick drying. It should also be nontoxic, odorless, have a high flash and boiling point (i.e. nonflammable), have no solvent action on toner, have a specific gravity equal to or greater than that of the dispersed toner, have no reaction with the charge receptor surface, and be compatible with additive control agents (e.g. fixing and charge control).

SUMMARY OF THE INVENTION

From the above shopping list of design parameters it can be readily understood that it is no easy task to formulate a toner package, including the pigmented marking particles and its solid or liquid carrier material, with satisfactory characteristics. The permutations increase dramatically when full color xerography is contemplated, because four colors of particles (i.e. black, cyan, magenta and yellow) must be formulated and each must have a compatible carrier. Every time a new xerographic system is designed, all the materials operative therein, including charge receptor surfaces as well as the developers, must be reconsidered and may have to be redesigned.

It is an object of the present invention to provide a system for greatly simplifying the design of a xerographic apparatus and its attendant materials by separating the developing function (i.e. attracting a properly charged material to the electrostatic latent image) from the coloring function. By so doing, only a single developer material need be designed for a given system. It should be understood, of course, that the complex design exercise still would have to be accomplished to formulate the single developer material, but this need be done only one time for each xerographic system and can be routinely accomplished by a skilled toner designer.

It is a further object of this invention to provide a developer material which is colorless and adhesive to be used in conjunction with colorant particles which will stick thereto solely by mechanical action or a colorant in the form of a dye suspended in a liquid medium, wherein the dye will migrate into the matrix of the developer material.

It is yet another object of this invention to use the adhesiveness of the developer material to transfer and adhere the entire colored image to an intermediate image receptor member or to a substrate sheet.

These objects may be carried out, in one form, by providing a xerographic marking apparatus including a charge receptor member, means for creating an electrostatic latent image on the charge receptor member, means for developing the electrostatic latent image for making it visible, and means for transfering and fixing the visible image onto a transfer sheet. The means for developing comprises first means for electrostatically depositing a colorless adhesive developer material upon the electrostatic latent image, and second means for coloring the colorless adhesive developer material.

BRIEF DESCRIPTION OF THE DRAWINGS

Other objects and further features and advantages of this invention will be apparent from the following, more particular, description considered together with the accompanying drawings, wherein.

DETAILED DESCRIPTION OF THE ILLUSTRATED EMBODIMENTS

Figure 1:
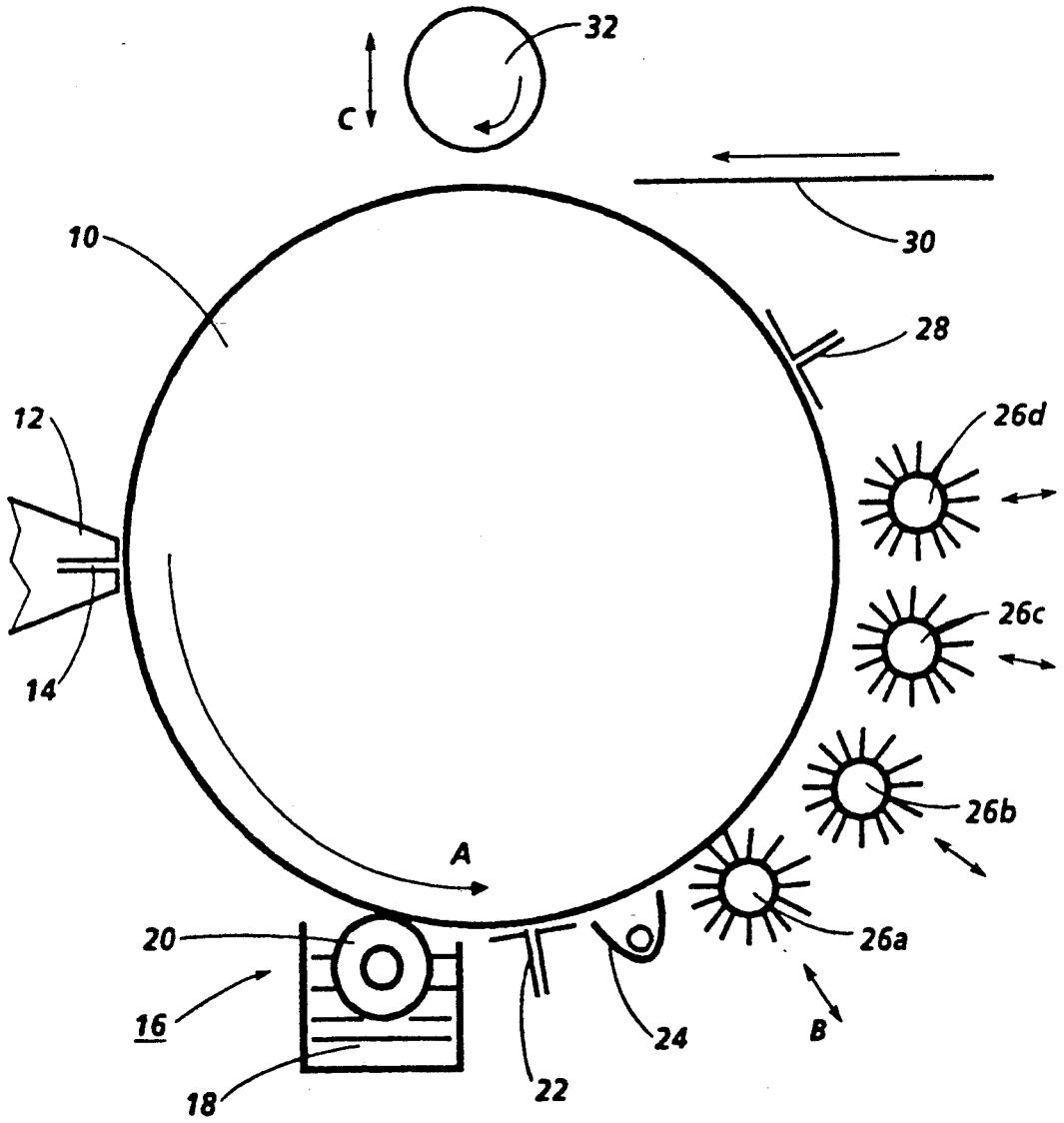
FIG. 1 is a schematic illustration of a xerographic machine configuration suitable for the process of the present invention.

Turning now to FIG. 1, there is illustrated an ionographic xerographic marking apparatus. It includes a charge receptor member 10 in the form of a metal drum bearing on its exterior surface a layer of a low surface energy dielectric material, such as Teflon® which is rotated in the direction indicated by arrow A. Of course, the charge receptor may also be in the form of an endless belt. An ionographic charge deposition head 12 extending the axial length of the drum 10 selectively projects charges of the appropriate sign onto the drum surface, in a line-by-line manner, through exit orifice 14 within which are ion stream modulating electrodes. The charges projected under process control form an electrostatic latent image of the information to be printed on the dielectric surface of the drum. Alternatively, the electrostatic latent image may be formed by electrophotography or laser xerography. Rotation of the charge receptor moves the latent image from the charging station through a development zone where the latent image may be made visible in the two-step development process which is the subject of the present invention. In the first step, a colorless adhesive developer material is electrostatically attracted to the latent image, and in the second step, colorant material is brought into contact with the adhesive imagewise pattern and is attached thereto. As illustrated, a liquid development station 16 including a sump 18 and an applicator roller 20 delivers the colorless adhesive developer particles to the drum surface. Thus, in addition to having all the requisite characteristics for developer materials, as set out above, the developer particles used herein will be colorless and will exhibit adhesiveness or tackiness.

Immediately after emerging from the liquid development station 16, excess solvent is removed by an air knife 22 and the developer material, which may have emerged from the liquid bath in a non-tacky state, may be made tacky by the application of heat thereto, by heater 24. Further rotation of the charge receptor surface moves the developed image past the colorant stations, shown in the form of four brush applicators **26*a*, 26*b*, 26*c* and 26*d*, where particulate colored pigment is applied to the adhesive surface of the developed image. The colorant stations are selectively moved into and out of operative relationship with the charge receptor 10 so that each applicator, when activated, passes particles of a single color material into contact with a colorless adhesive image or partial image. Note that brush applicator 26*a* is in a colorant dispensing mode while brush applicators 26*b*, 26*c* and 26*d* are in a non-dispensing mode. Although the arrows B indicate physical movement toward and away from the charge receptor they may be understood to represent also a gating mechanism within the applicator structure which selectively renders a stationary housing either operative or inoperative. Subsequent to the coloration step, any excess finely divided particulate colorant material adhering to the non-imaged, or background, areas of the charge receptor surface may beremoved aggressively by an air knife 28** or some other cleaning mechanism which will not disturb the developed image areas.

Although the drawing illustrates plural colorant application stations 26, this imaging apparatus may be used to produce monochrome images, it may produce a two color image comprising a primary color with highlight color, or it may be used to produce polychrome images being made up of several superimposed partial color images. When more than a single color image is to be produced, each partial image is formed during a single rotation of the drum 10.

After coloration has been completed at as many of the colorant stations as is required, the final image may be readily transferred and affixed to a suitable substrate, such as paper sheet 30 by a pressure roller 32. The adhesiveness of the developer material, which is relied upon to attract and to retain the colorant material, should persist through image formation and may be used also to adhere the final image to the paper sheet. Transfer to the paper should be readily accomplished by the pressure applied by roller 32 and, if neccesary the further application of heat. The adhesive developer material will have a greater affinity for the paper and, if it is a multicolor image, for the other partial images in the image stack, than for the low surface energy material on the drum surface. Therefore, the entire image stack will preferentially adhere to the paper 30 rather than the drum 10. In order to enhance the adhesion of the image to the paper in the transfer step, it may be desirable to deposit a final transfer layer of the colorless adhesive developer material in complete image configuration atop the final image.

When a single color image is to be formed, the electrostatic latent image is developed with the colorless adhesive developer material which in turn is colored with the desired colorant particles. When images of more than one color are desired to be formed, the charge receptor 10 is moved past the charge deposition head 12 once for each partial latent image to be deposited and at each pass the correct colorant station 26 is made operative and the others are rendered inoperative. If the colorant step is carried to completion, i.e. fully loading the surface of the adhesive developer material with colorant particles, there will be no contamination of a preceding colored partial image by a subsequent one, because the surface of the adhesive developer layer will no longer be exposed and be able to accept colorant particles. It should be noted also that the pressure roller 28 is movable toward and away from the charge receptor drum 10 (as indicated by arrow C) and will be moved to the drum surface only after the image is complete and transfer to sheet 30 is to be effected.

Figure 2:
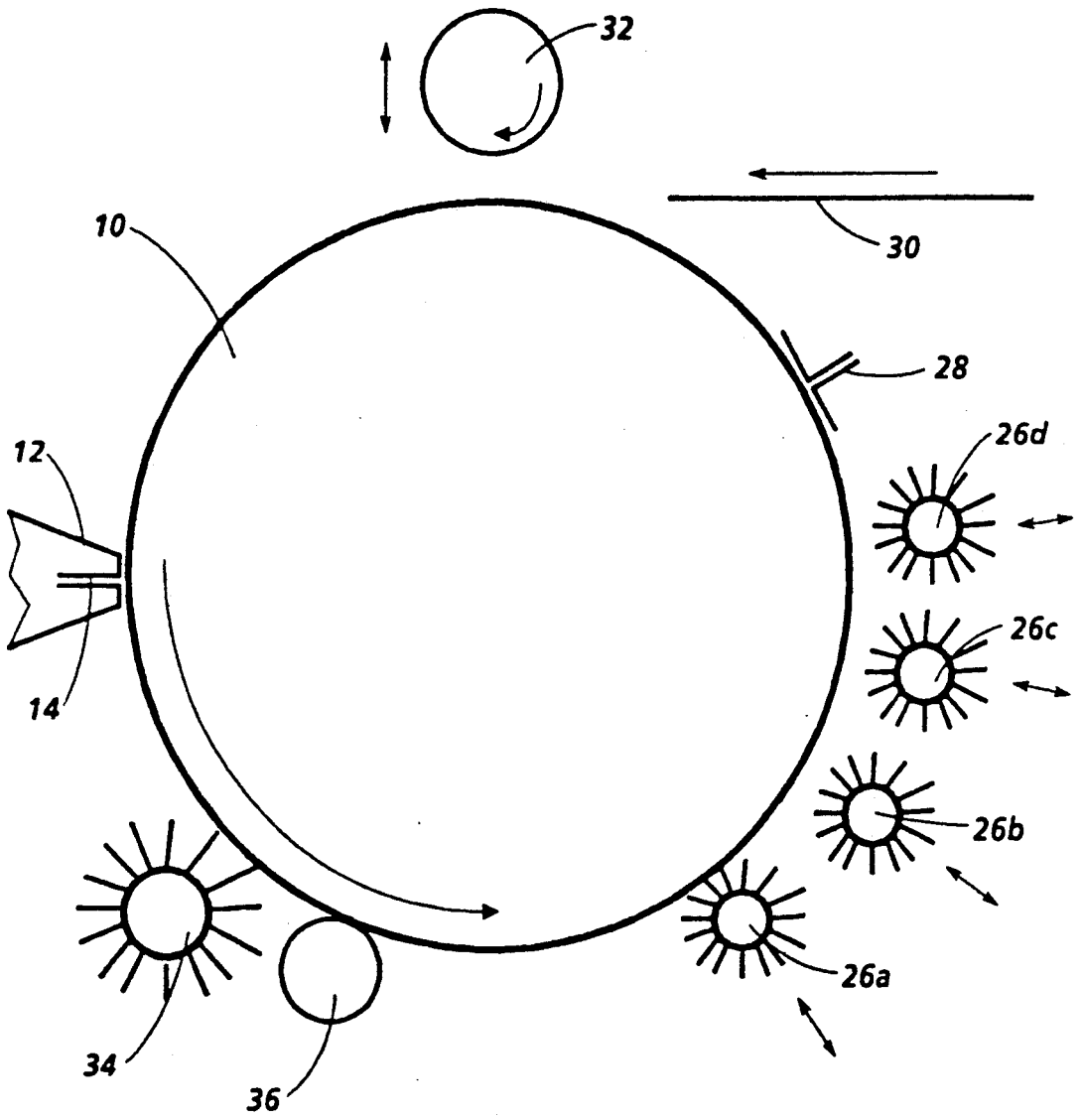
FIG. 2 is a schematic illustration of the xerographic machine of FIG. 1 with an alternative development station.

In the embodiment of FIG. 2 a similar apparatus is shown with a powder developer applicator 34 for depositing the colorless adhesive developer material upon the image receptor. Although a brush applicator is schematically illustrated, any suitable mechanism may be utilized for transporting dry powder developer over the surface of the charge receptor. Dry powder developer materials, such as encapsulated adhesives, delayed tack adhesives or hot melt adhesives, are more easily applied to the electrostatic image if they are not in an adhesive state. In order to render them tacky for accepting colorant particles, an activator element 36 may be provided directly adjacent to the developer station. This element may take many forms. For example, if the developer particles comprise an adhesive material encapsulated in a rupturable shell, activator element 36 may be a pressure roller which will break open the shells. If the developer particles become tacky with the application of thermal or optical energy, element 36 may take the form of a heat lamp or a lamp of the appropriate optical frequency. Alternatively, activator element could be an applicator roller to deliver solvent or a catalytic agent to tackify the developer particles. Other elements may be the same as that described with respect to the device of FIG. 1. Thus, while an adhesive developer has been called for it should be understood that this characteristic need not be present in the material as applied, in either its liquid or powder forms, nor need it be present after the final image has been on the paper substrate for some period of time. In fact, it is preferable if the tacky nature of the developer material lasts only as long as necessary for the application of colorant and its transfer in image configuration to the paper. Once on the paper it should no longer exhibit any tackiness.

Figure 3:
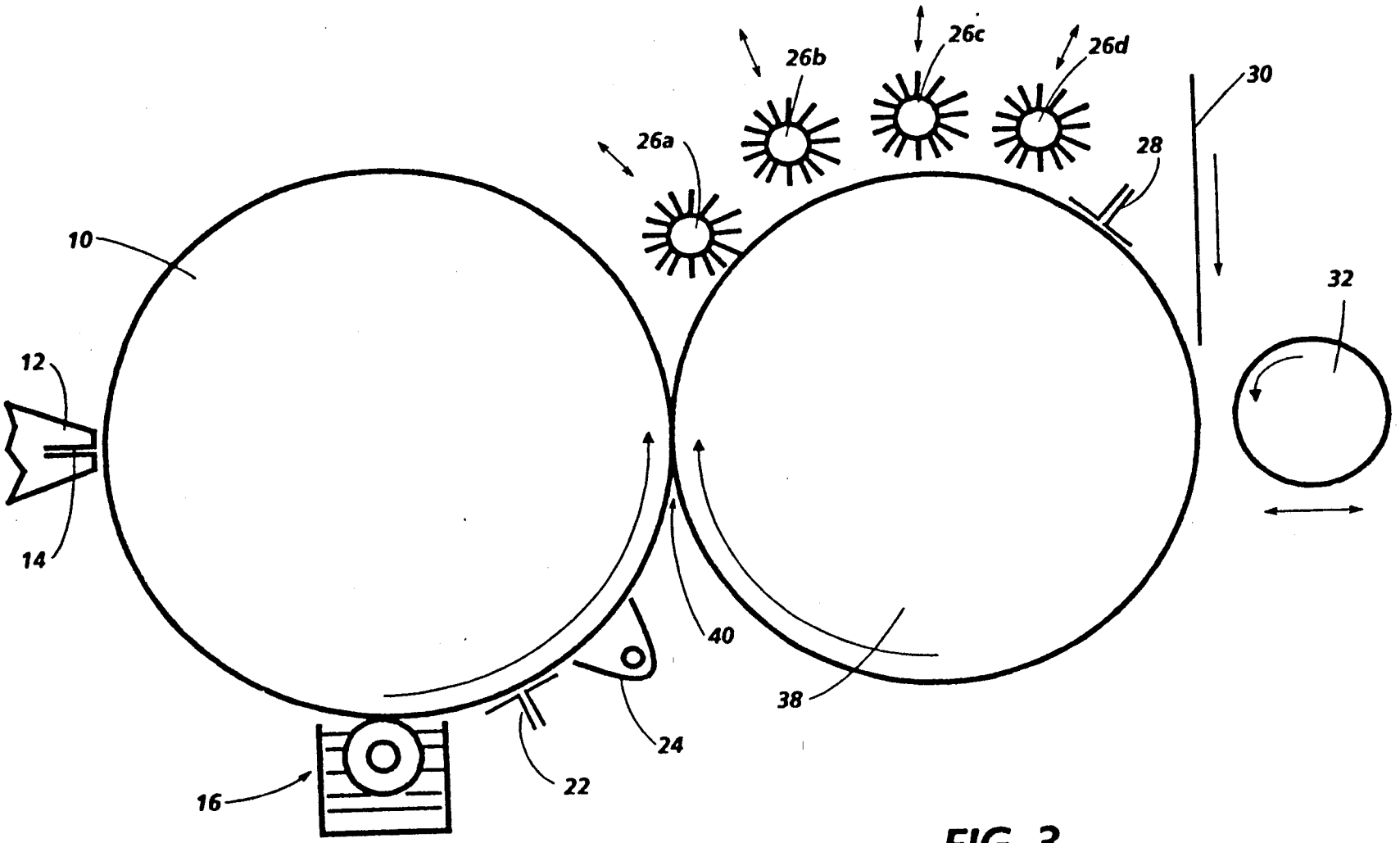
FIG. 3 is a schematic illustration of another xerographic machine configuration including an intermediate transfer member.

In the devices illustrated in both FIGS. 1 and 2 coloration takes place on the same surface on which the electrostatic latent image is formed. Although it is intended in these arrangements that the cumulative layers of adhesive developer and colorants (in the case of plural color images) be extremely thin, the capacitance of the drum dielectric changes as these partial image layers build up, resulting in image degradation unless this change is taken into account in the process control. The solution proposed in the apparatus configuration illustrated in FIG. 3 is to always deposit the charge directly upon the charge receptor surface. The colorless adhesive developer material for each partial image is applied to the charge on the charge receptor surface and is then transferred to an intermediate or holding member 38 upon which its coloration takes place at the appropriate colorant station 26*a* to 26*d*. Either one or both of the moving processing surfaces may be in the form of drums, as shown, or in the form of endless belts. By judicious selection of the surface layer materials of the charge receptor and the intermediate member, the developed colorless adhesive image will preferentially adhere to the latter and is transferred thereto in the nip 40 between these two elements. After the last partial image is colored, the final image stack will be transferred to substrate sheet 32 by means of pressure applied by pressure roller 30.

Figure 4:
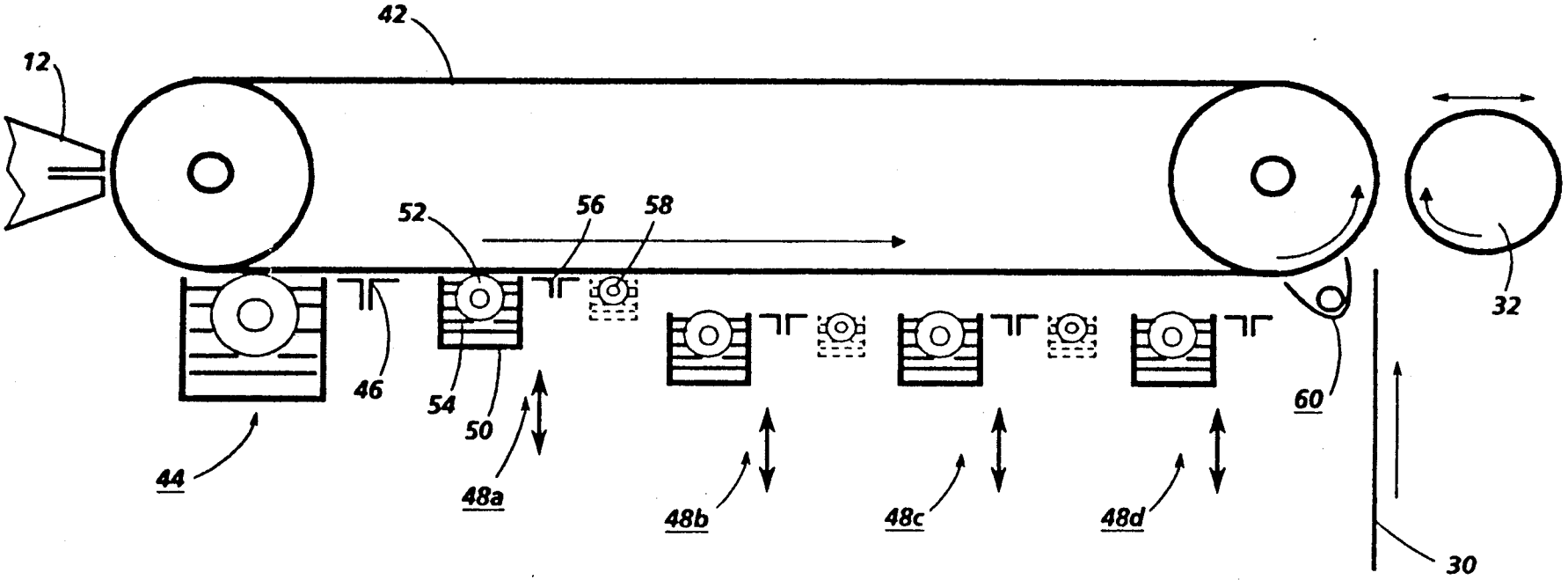
FIG. 4 is a schematic illustration of still another xerographic machine in a belt configuration for coloring with dyes.
Figure 5:
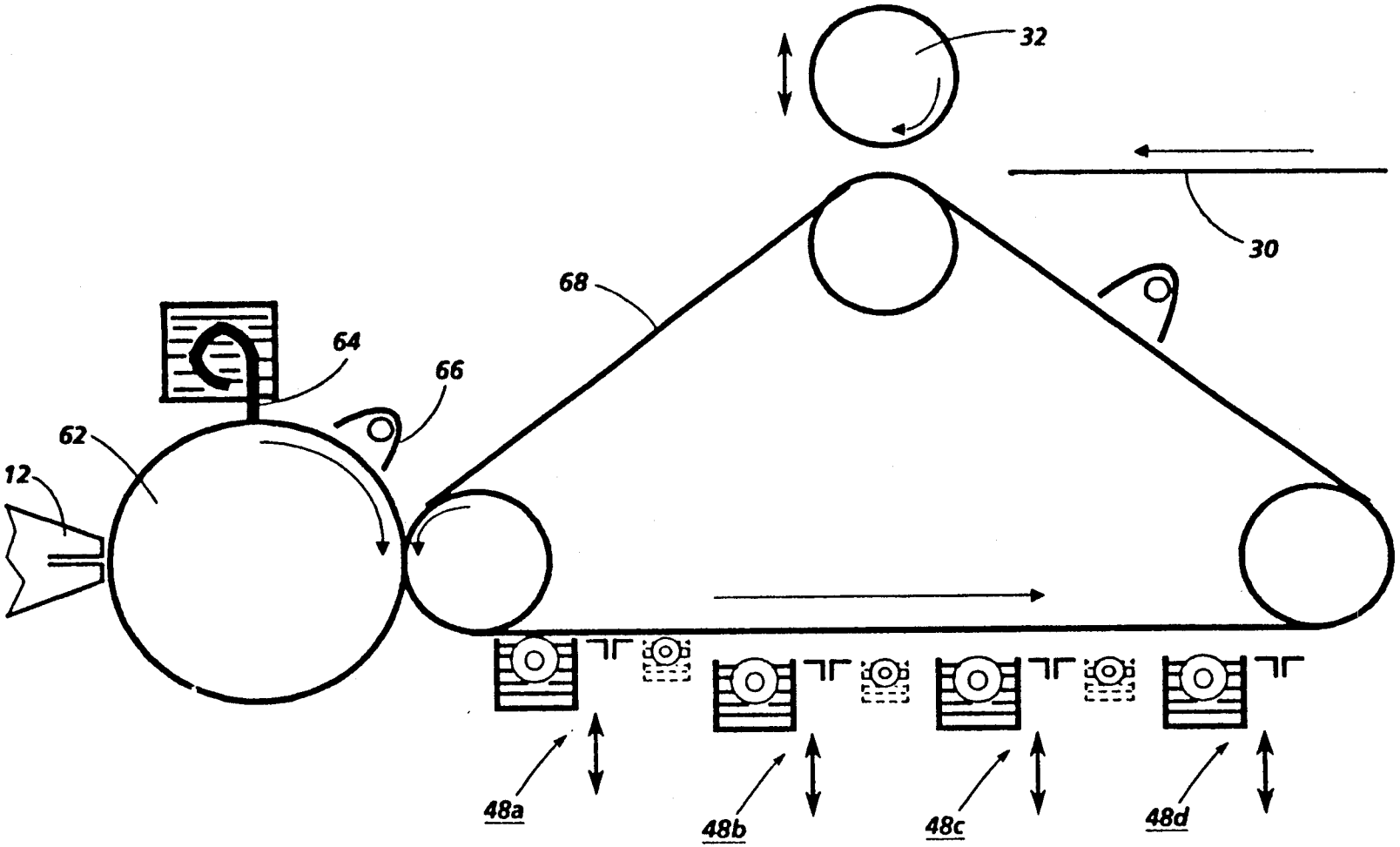
FIG. 5 is a schematic illustration of the FIG. 4 embodiment modified by the introduction of an intermediate transfer member.

Enhanced images may be formed with the arrangement shown in FIG. 4. A charge receptor belt 42 has an electrostatic latent image formed thereon by charge deposition head 12 which image is developed at a liquid developer application station 44 where colorless adhesive developer material is attracted thereto. Immediately after emerging from the liquid development station 44, excess solvent is removed by an air knife 46. Although a liquid development station is shown, a powder development station may also be used. Colorant stations 48*a*, 48*b*, 48*c* and 48*d* are selectively made operative (note that station 48*a* is shown in dispensing position) to dispense a dye suspended in solution. Each colorant station comprises a liquid applicator 50 including a dispensing roller 52 immersed in a bath 54. Alternatively, it is possible to wipe the dye solution onto the charge receptor surface from a porous dispenser material, comparable to a felt-tip pen, having an end immersed in a bath of dye solution and wicking the colorant therethrough (as shown in FIG. 5). Such an arrangement could be fabricated extremely simply and inexpensively.

As opposed to the particulate colorants used in liquid or powder development, the dye exists as independent molecules in solution. Dye colorants may readily be designed so as to be absorbed selectively into the particular adhesive developer material and not into the charge receptor surface. The solution holding the dye should be chosen to have an affinity for the adhesive developer, so that upon contact therewith it will cause the developer material to swell and to allow the solution and dye molecules to enter into its matrix. By constructing the charge receptor member 42 in the form of a thin metal belt with an appropriate low surface energy coating, the coating will not be affected by the dye during the coloration step. If some excess dye adheres slightly to the coating in the non-image areas, it can be readily removed by a suitable cleaning device, such as air knife 56. As in the previous arrangements, each partial color image is formed by first developing with the colorless adhesive developer and then coloring the developer. The partial images are deposited one upon the other. Since the previously applied partial developer image is capable of being colored by a subsequently applied dye, there is provided at colorant stations 48*a* to 48*c* a dye stop applicator 58 for applying an extremely thin layer of dye stop material, which establish a barrier over the previously colored partial image, and will prevent the developer from accepting subsequent dyes. Such an applicator will not be required at the final colorant station 48*d* since no subsequent dye is to be applied to the image.

The dyed partial image adhesive layers may be made extremely thin so that the appearance of the final multicolor built-up image on the paper will have a more attractive appearance than the particulate colorant multicolor xerographic images. Also, since the absorption of dye into the adhesive developer layer should not affect its surface adhesiveness, its built-up layers will have a greater affinity for one another and for the paper surface than for the image receptor surface, and it should be possible to transfer the entire built-up image readily by the application of pressure. If desired a final, complete adhesive image may be developed to assist in the transfer step. In the event that the selected developer material is not tacky as developed, and needs to be made tacky in order to effect transfer, a heater 60 may be provided prior to the transfer station.

This embodiment uniquely enables the production of continuous tone monochrome or full color images. During the development step, the imagewise thickness of the colorless adhesive material will be proportional to the imagewise charge distribution of the electrostatic image, i.e. areas to be darker will have a greater charge density and will develop thicker. Since the dye actually migrates into the solid volume of the developer layer, if the coloration step is effected to completion, the optical density of the image (or partial image) will be proportional to the thickness of the developer layer.

In FIG. 5 the electrostatic latent images also are formed on charge receptor 62 drum by charge deposition head 12. The latent images are then developed thereon, as by porous dispenser member 64, followed by the application of heat by heating element 66 for removing excess solvent and rendering the developed images tacky. The tackified developed adhesive images are transferred to intermediate, or holding member 68, upon which coloration takes place at stations 48*a* to 48*d*. As in the FIG. 3 device, the charge receptor member is reserved solely for development of the electrostatic charge images.

Figure 6:
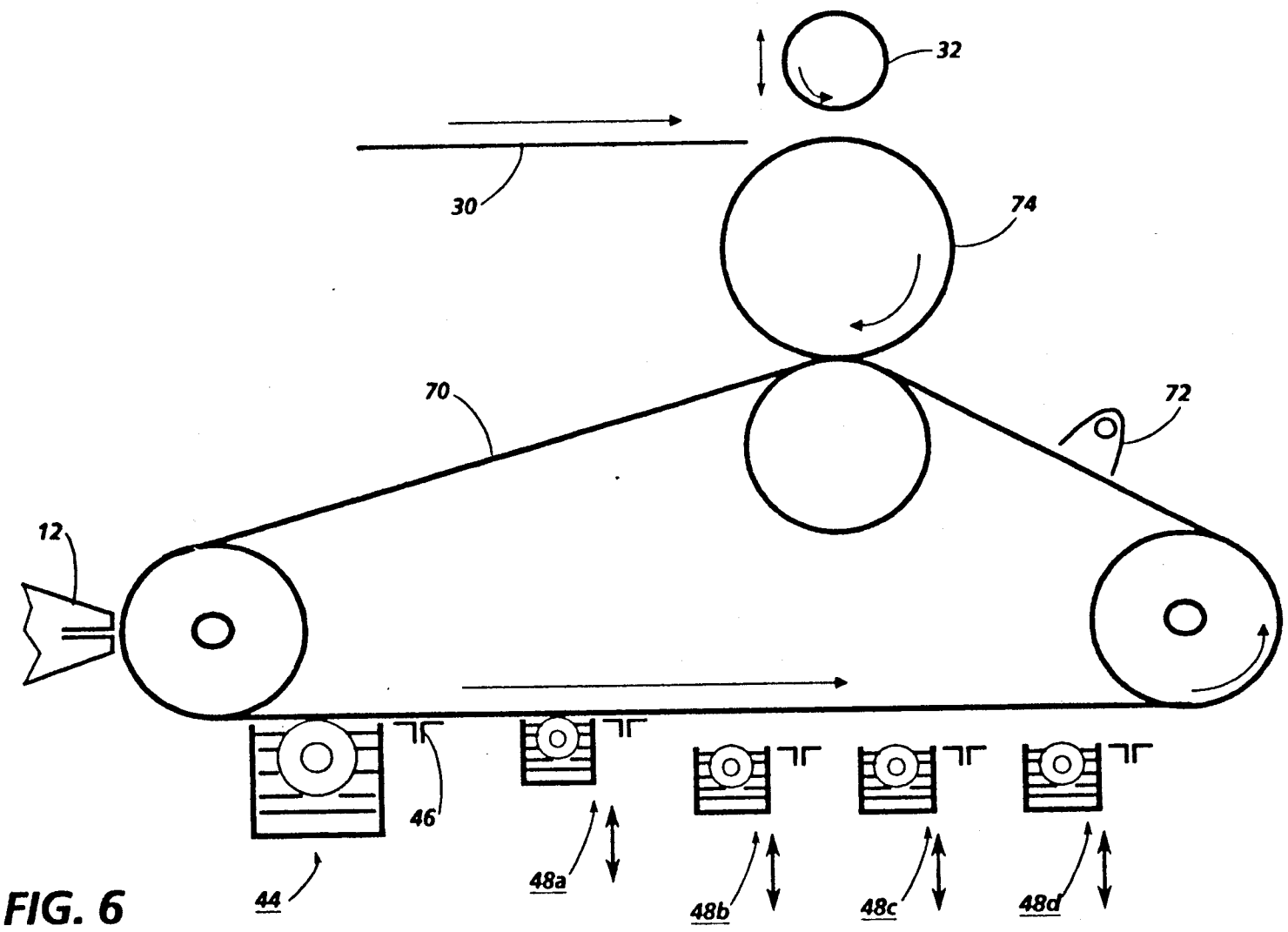
FIG. 6 is a schematic illustration of another modification of the FIG. 4 embodiment including an intermediate transfer member.

The proposed apparatuses of FIGS. 4 and 5 each require that a dye stop be applied over each dyed partial image because the partial images are built up one upon the other. This may not be desirable because it increases the thickness of the image stack. In FIG. 6 there is shown an alternative apparatus which eliminates the necessity of appling a dye stop. As in the other configurations of this invention, electrostatic latent images are formed on charge receptor belt 70 by charge deposition head 12, the images are developed with a colorless adhesive developer material (a liquid developer application station 72 is shown), excess solvent is removed by an air knife 74, and the developed images are made visible at dye colorant stations 48*a*, 48*b*, 48*c* and 48*d*. After each partial image has been dyed it is tackified, as by heater 72 and it is transferred to intermediate, or holding, member 74 in registration with the other partial images thereon. In this manner no previous adhesive image resides upon the charge receptor to be inadvertantly dyed at a subsequent dye colorant station. After all of the partial images have been formed, developed, colored, and tranferred to the holding member, the final image stack will be transferred to sheet 30.

Since the unique development method of the present invention requires comprehensive material design for only a single developer material, the colorant materials are freed from the enormous number of compatibility constraints previously assigned to them. Color images can be achieved either additively or subtractively depending upon whether the colorants are opaque or colorless. Any colorant may be used, allowing precision in the representation of unique colors (such as those associated with company logos) as opposed to forming a unique, much used, color as a combination of basic colors. Color proofing devices may be made wherein the colorants used could be identical to those used in the actual printing inks. Images can be easily made from virtually any colorant material as needed for a specific function, such as insulating, conductive, magnetic, biological and mineral. Furthermore, the process of the present invention allows the known electrostatic transfer and heat fusing steps to be eliminated, thereby substantially lowering the cost of this device.

It should be understood that the present disclosure has been made only by way of example, and that numerous changes in details of construction and the combination and arrangement of parts may be resorted to without departing from the true spirit and scope of the invention as hereinafter claimed.

What is claimed:

1. A xerographic marking apparatus including a charge receptor member, means for creating an electrostatic latent image on said charge receptor member, means for developing said electrostatic latent image for making it visible, and means for transferring and fixing said visible image onto a transfer member, wherein said means for developing comprises first means for electrostatically depositing a colorless adhesive developer material upon said electrostatic latent image, and second means for coloring said colorless adhesive developer material including means for passing colorant particles into contact with said colorless adhesive developer material.

2. The xerographic marking apparatus as defined in claim 1 wherein said second means brings dye material into contact with said colorless adhesive developer material for absorption therein.

3. The xerographic marking apparatus as defined in claim 2 wherein said second means comprises plural dye application stations for the application of different color dyes to said developer material, and plural dye stop application stations for overlaying a dye stop material over said dyed developer material for providing a barrier layer to the absorption of further dye material.

4. The xerographic marking apparatus as defined in claim 1 wherein said colored developer material is adhesively attached to said transfer member by said means for transferring and fixing.

5. The xerographic marking apparatus as defined in claim 1 wherein said colorless adhesive developer material is deposited by said first means in a non-adhesive state and said apparatus further includes third means for transforming said developer material from said non-adhesive state to an adhesive state prior to being colored.

6. The xerographic marking apparatus as defined in claim 1 wherein said colorless adhesive developer material is deposited by said first means in a non-adhesive state and said apparatus further includes third means for transforming said developer material from said non-adhesive state to an adhesive state subsequent to being colored.

7. The xerographic marking apparatus as defined in claim 5 wherein said first means comprises a liquid development applicator which deposits said developer material and a liquid carrier material on said charge receptor, and said third means comprises means for applying thermal energy to remove said liquid carrier material from said charge receptor and to tackify said developer material.

8. The xerographic marking apparatus as defined in claim 6 wherein said first means comprises a liquid development applicator which deposits said developer material and a liquid carrier material on said charge receptor, and said third means comprises means for applying thermal energy to remove said liquid carrier material from said charge receptor and to tackify said developer material.

9. The xerographic marking apparatus as defined in claim 5 wherein said third means comprises means for applying optical energy to tackify said developer material.

10. The xerographic marking apparatus as defined in claim 5 wherein said developer material comprises particles each having a rigid shell containing a fluid adhesive material, and said third means comprises means for rupturing said rigid shell.

11. The xerographic marking apparatus as defined in claim 1 further including a holding member for receiving said electrostatically deposited colorless adhesive developer material from said charge receptor and upon which said second means colors said adhesive developer material to make it visible, and wherein said visible image is applied to said transfer member from said holding member.

12. The xerographic marking apparatus as defined in claim 1 wherein said second means comprises plural colorant stations for applying different colors to developed electrostatic partial images on said charge receptor, and further including a holding member for receiving said colored developed electrostatic partial images one-at-a-time from said charge receptor, and wherein a complete image, comprising all of said partial images, is applied to said transfer member from said holding member.

13. An imaging apparatus including, in operative relationship, an imaging means, means for generating an electrostatic latent image on said imaging means, and means for developing said electrostatic latent image, said means for developing comprising first means for electrostatically depositing a colorless adhesive developer material upon said electrostatic latent image, and second means for coloring said colorless adhesive developer material including means for passing colorant particles into contact with said colorless adhesive developer material.

14. The imaging apparatus as defined in claim 13 wherein said first means employs a dry development process.

15. The imaging apparatus as defined in claim 13 wherein said first means employs a liquid development process.

16. The imaging apparatus as defined in claim 15 further including means for removing excess liquid developer from said imaging means.

17. The imaging apparatus as defined in claim 15 further including means for transforming said developer material from a non-adhesive state to an adhesive state prior to being colored.

18. The imaging apparatus as defined in claim 17 wherein said second means passes colorant particles over said developer material in its adhesive state.

19. The imaging apparatus as defined in claim 13 wherein said second means passes a liquid bearing dye material therein over said developer material, said dye material having an affinity for said developer material.

20. The imaging apparatus as defined in claim 13 wherein said second means comprises a plurality of stations each including a different colorant material.

21. A xerographic marking process including the steps of moving a charge receptor member in a recirculating manner, creating an electrostatic latent image on said charge receptor member, developing said electrostatic latent image for making it visible, transferring and fixing said visible image onto a transfer member, wherein said step of developing comprises electrostatically depositing a colorless adhesive developer material upon said electrostatic latent image, and coloring said colorless adhesive material by passing colorant particles into contact with said colorless adhesive developer material.

22. The xerographic marking process as defined in claim 21 wherein said colored developer material is adhesively attached to said transfer member.

23. The xerographic marking process as defined in claim 22 further including electrostatically depositing said colorless adhesive developer material upon said colored developer material for adhesively attaching said colored developer material to said transfer member.

* * * * *